US011096538B2

(12) United States Patent
Hwang et al.

(10) Patent No.: US 11,096,538 B2
(45) Date of Patent: Aug. 24, 2021

(54) CLEANER

(71) Applicant: LG Electronics Inc., Seoul (KR)

(72) Inventors: Philjae Hwang, Seoul (KR); Mantae Hwang, Seoul (KR); Jungbae Hwang, Seoul (KR); Eunji Sung, Seoul (KR); Taekgi Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/137,284

(22) Filed: Dec. 29, 2020

(65) Prior Publication Data

US 2021/0113045 A1 Apr. 22, 2021

Related U.S. Application Data

(63) Continuation of application No. 16/325,326, filed as application No. PCT/KR2017/006443 on Jun. 20, 2017.

(30) Foreign Application Priority Data

Aug. 25, 2016 (KR) ..... 10-2016-0108310

(51) Int. Cl.
*A47L 9/28* (2006.01)
*A47L 9/32* (2006.01)

(52) U.S. Cl.
CPC ..... *A47L 9/2857* (2013.01); *A47L 9/28* (2013.01); *A47L 9/2842* (2013.01); *A47L 9/32* (2013.01); *A47L 9/322* (2013.01)

(58) Field of Classification Search
CPC ..... A47L 9/2857; A47L 9/28; A47L 9/2842; A47L 9/32; A47L 9/322
See application file for complete search history.

(56) References Cited

U.S. PATENT DOCUMENTS

| | | | |
|---|---|---|---|
| 3,766,347 | A | 10/1973 | Brooks et al. |
| 4,654,924 | A | 4/1987 | Getz et al. |
| 5,884,358 | A | 3/1999 | Kim |
| 9,711,986 | B2 | 7/2017 | Sunderland et al. |
| 2002/0074219 | A1 | 6/2002 | Crevling |

(Continued)

FOREIGN PATENT DOCUMENTS

| | | |
|---|---|---|
| CN | 103784081 | 5/2014 |
| JP | 2012050564 | 3/2012 |

(Continued)

OTHER PUBLICATIONS

Korean Notice of Allowance in KR Appln. No. 2020-087018237, dated Dec. 11, 2020, 4 pages (with English translation).

(Continued)

*Primary Examiner* — Andrew A Horton
(74) *Attorney, Agent, or Firm* — Fish & Richardson P.C.

(57) ABSTRACT

A cleaner includes: a suction motor that generates a suction force; and an operation unit that is configured to input control instruction for the suction motor. The operation unit includes: a support frame; a first push part that is rotatably seated on the support frame and allows an instruction to turn on or off the suction motor to be input when being rotated in a first direction; and a second push part that allows the intensity of the suction force of the suction motor to be adjusted when being rotated in a second direction.

14 Claims, 15 Drawing Sheets

(56) References Cited

U.S. PATENT DOCUMENTS

| | | | | |
|---|---|---|---|---|
| 2009/0265877 | A1* | 10/2009 | Dyson | A47L 9/22 15/344 |
| 2013/0205538 | A1 | 8/2013 | Thompson | |
| 2013/0207615 | A1 | 8/2013 | Sunderland et al. | |

FOREIGN PATENT DOCUMENTS

| | | |
|---|---|---|
| JP | 2013059525 | 4/2013 |
| JP | 2014083241 | 5/2014 |
| JP | 2014176567 | 9/2014 |
| JP | 2015173674 | 10/2015 |
| JP | 2016131795 | 7/2016 |
| KR | 1019980013972 | 6/1998 |
| KR | 100237047 | 1/2000 |
| KR | 1020030032495 | 4/2003 |
| KR | 100570293 | 4/2006 |
| KR | 1020110121997 | 11/2011 |
| KR | 1020140123087 | 10/2014 |
| KR | 20140127305 | 11/2014 |
| KR | 20190104973 | 9/2019 |
| KR | 102138214 B1 | 7/2020 |
| WO | WO2011138980 | 11/2011 |

OTHER PUBLICATIONS

Australian Examination Report in Australian Appln. No. 2017314600, dated May 15, 2019, 4 pages.
Extended European Search Report in European Appln. No. 17843793.5, dated May 24, 2019, 7 pages.
Korean Notice of Allowance in Korean Appln. No. 10-2019-0109101, dated Apr. 27, 2020, 7 pages(with English translation).

* cited by examiner

CLEANER

CROSS-REFERENCE TO RELATED APPLICATIONS

This application is a continuation of U.S. application Ser. No. 16/325,326, filed on Feb. 13, 2019, which is a National Stage application under 35 U.S.C. § 371 of International Application No. PCT/KR2017/006443, filed on Jun. 20, 2017, which claims the benefit of Application No. 10-2016-0108310, filed on Aug. 25, 2016. The disclosures of the prior applications are incorporated by reference in their entirety.

TECHNICAL FIELD

The present disclosure relates to a cleaner.

BACKGROUND ART

Cleaners may be classified into a manual cleaner that a user moves in person for cleaning and an automatic cleaner that automatically moves for cleaning.

Manual cleaners may fall into, depending on the types, a canister cleaner, an upright cleaner, a handy cleaner, and a stick cleaner.

Handy cleaners, generally, may include a suction unit, a body, and a handle.

Meanwhile, in the related art, a handheld vacuum cleaner has been disclosed in Korean Patent No. 10-1127088 (registered on 8 Mar. 2012).

The handheld vacuum cleaner includes a suction pipe, an airflow generator, a cyclone, a power supply, and a handle.

A trigger switch for turning on or off the airflow generator is disposed at the handle.

According to this prior art document, however, since the airflow generator is turned on or off by the trigger switch, it is impossible to control the intensity of airflow with the airflow generator turned on.

Further, according to this prior art document, since the trigger switch is positioned on the handle with which a user's palm comes in contact, the user may unexpectedly operate the trigger switch while cleaning with the handle in his/her hand.

DISCLOSURE OF THE INVENTION

Technical Problem

The present disclosure provides a cleaner that allows a user to input an instruction to turn on or off a suction motor using an operation unit, and to control the intensity of suction force of the suction motor with the suction motor turned on.

The present disclosure provides a cleaner of which an operation unit is not unexpectedly operated during cleaning.

The present disclosure provides a cleaner that allows a user to input an instruction to turn on or off a suction motor using an operation unit, and to control the intensity of suction force of the suction motor through one operation button.

The present disclosure provides a cleaner in which a push part for turning on and off a suction motor and a push part for adjusting the intensity of the suction force are not simultaneously pressed when an operation unit is operated.

Technical Solution

A cleaner includes: a suction motor that generates a suction force; and an operation unit that is configured to input control instructions for the suction motor, wherein the operation unit has: a support frame; a first push part that is rotatably seated on the support frame and allows an instruction to turn on or off the suction motor to be input when being rotated in a first direction; and a second push part that allows the intensity of the suction force of the suction motor to be adjusted when being rotated in a second direction.

A cleaner includes: a suction unit that guides air and dust; a main body that has a dust separator separating dust from air guided by the suction unit; and an operation unit that is configured to input control instructions for a suction motor, wherein the operation unit is positioned higher than a longitudinal axis of the suction unit and has a first push part that allows a first instruction to be input when being rotated in a first direction and a second push part that allows a second instruction to be input when being rotated in a second direction.

Advantageous Effects

According to the present embodiment, it is possible to not only input instructions to turn on and off the suction motor, but adjust the intensity of the suction force of the suction motor that has been turned on through the operation unit, so a user can adjust the suction force while cleaning.

For example, when the intensity of the suction force is large, the available cleaning time may be reduced, but the cleaning effect can be improved. In contrast, when the intensity of the suction force is small, the cleaning effect may be reduced, but the available cleaning time is increased.

Further, according to the present embodiment, since the operation unit is positioned higher than the grip of the handle, it is possible to prevent a user from unexpectedly operate the operation unit with the grip in his/her hand.

Further, according to the present embodiment, since it is possible to not only input instructions to turn on and off the suction motor, but adjust the intensity of the suction force of the suction motor through one operation button, a user can more conveniently use the cleaner.

Further, according to the present embodiment, since operation instructions can be input by rotation of the operation unit, it is possible to prevent the switch that receives instructions to turn on and off the suction motor and the switch that receives instructions to adjust the intensity of the suction force from being simultaneously pressed when operating the operation button.

DETAILED DESCRIPTION OF THE EMBODIMENTS

Figure 1:
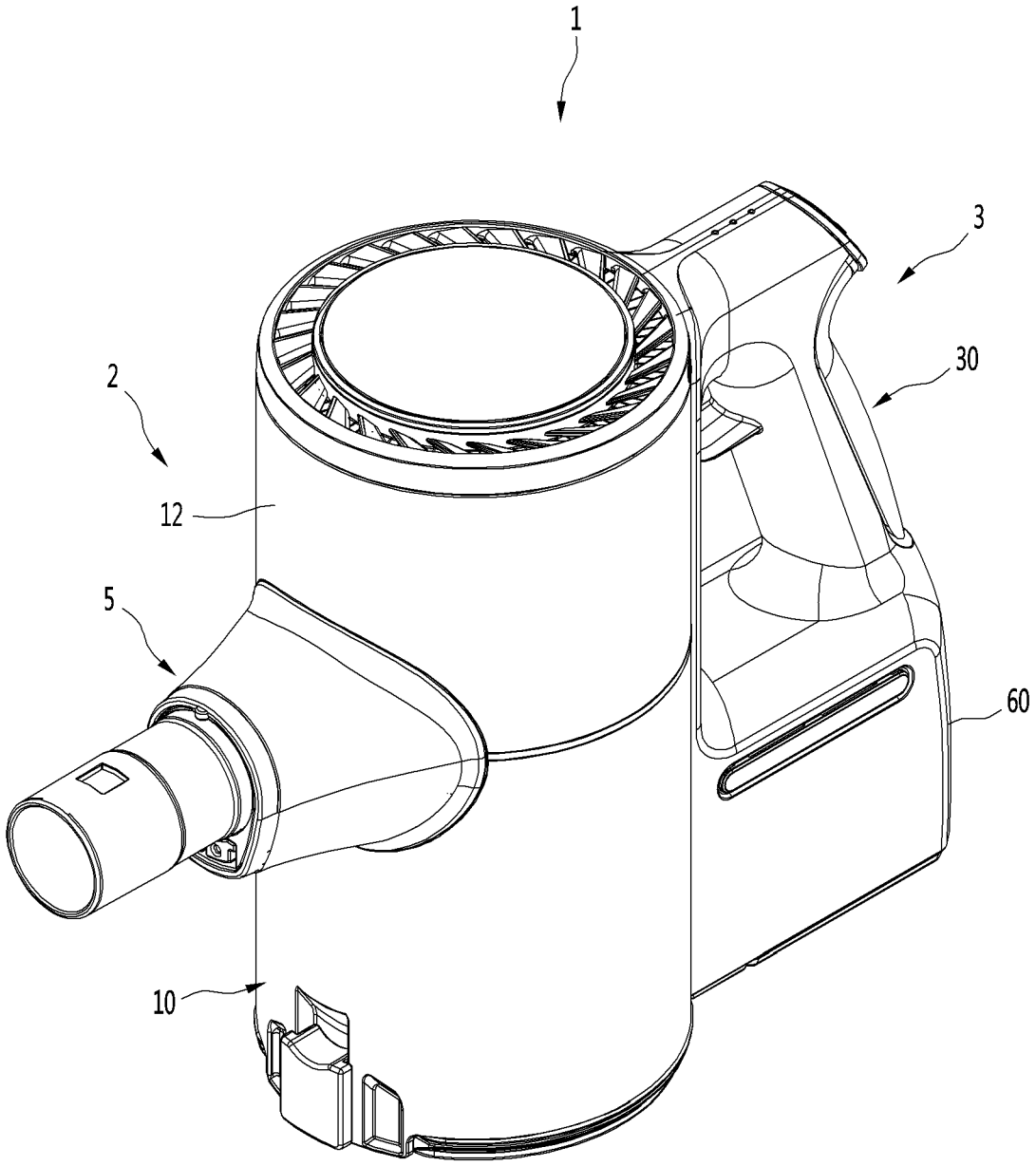
FIG. 1 is a perspective view of a cleaner according to an embodiment of the present invention.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
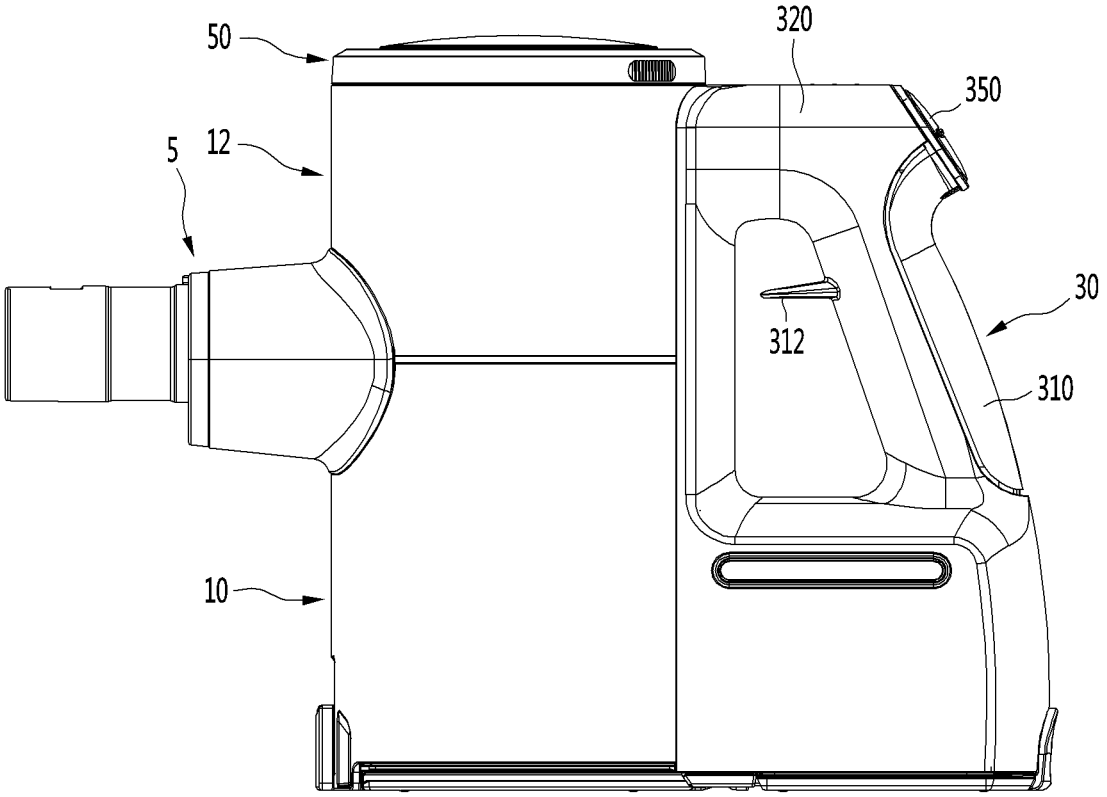
FIG. 2 is a side view of the cleaner according to an embodiment of the present invention.
Figure 3:
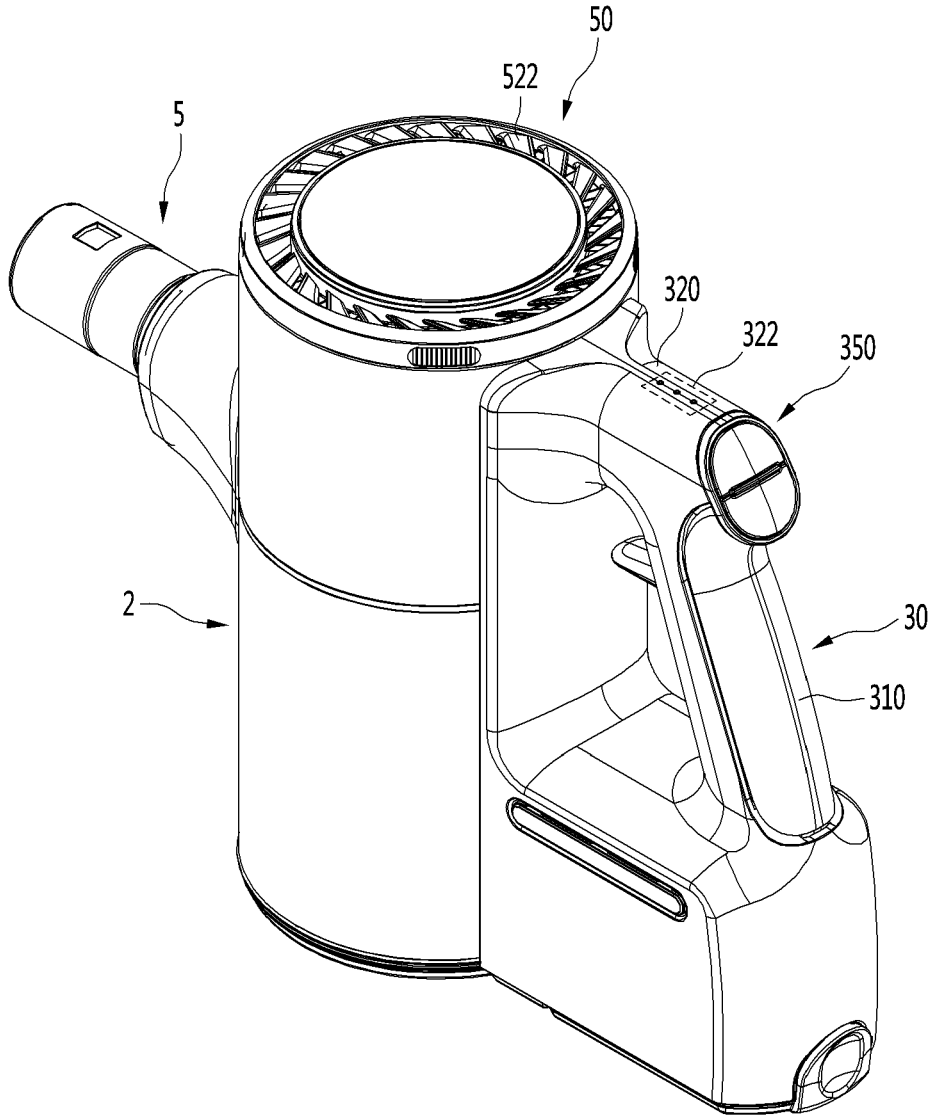
FIG. 3 is a plan view of the cleaner according to an embodiment of the present invention.
Figure 4:
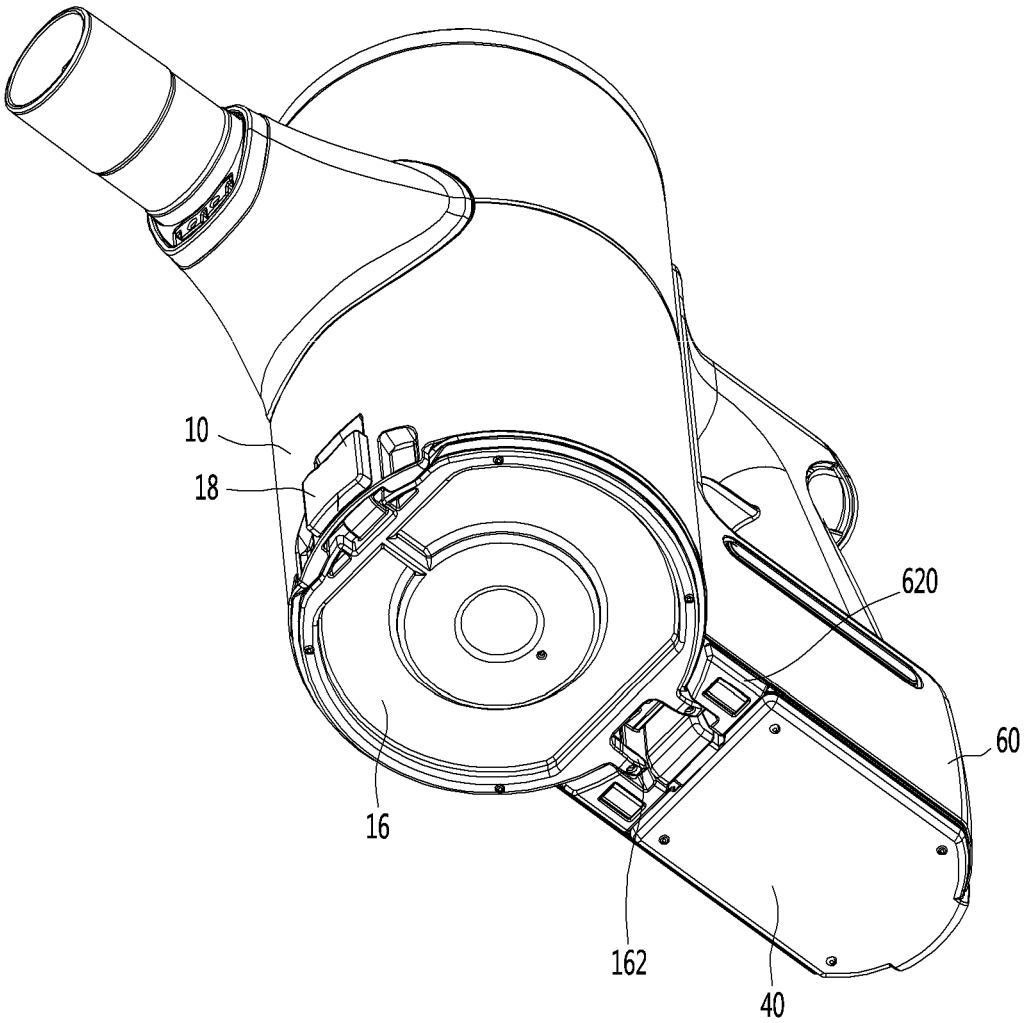
FIG. 4 is a perspective view of the cleaner according to an embodiment of the present invention when seen from under the cleaner.
Figure 5:
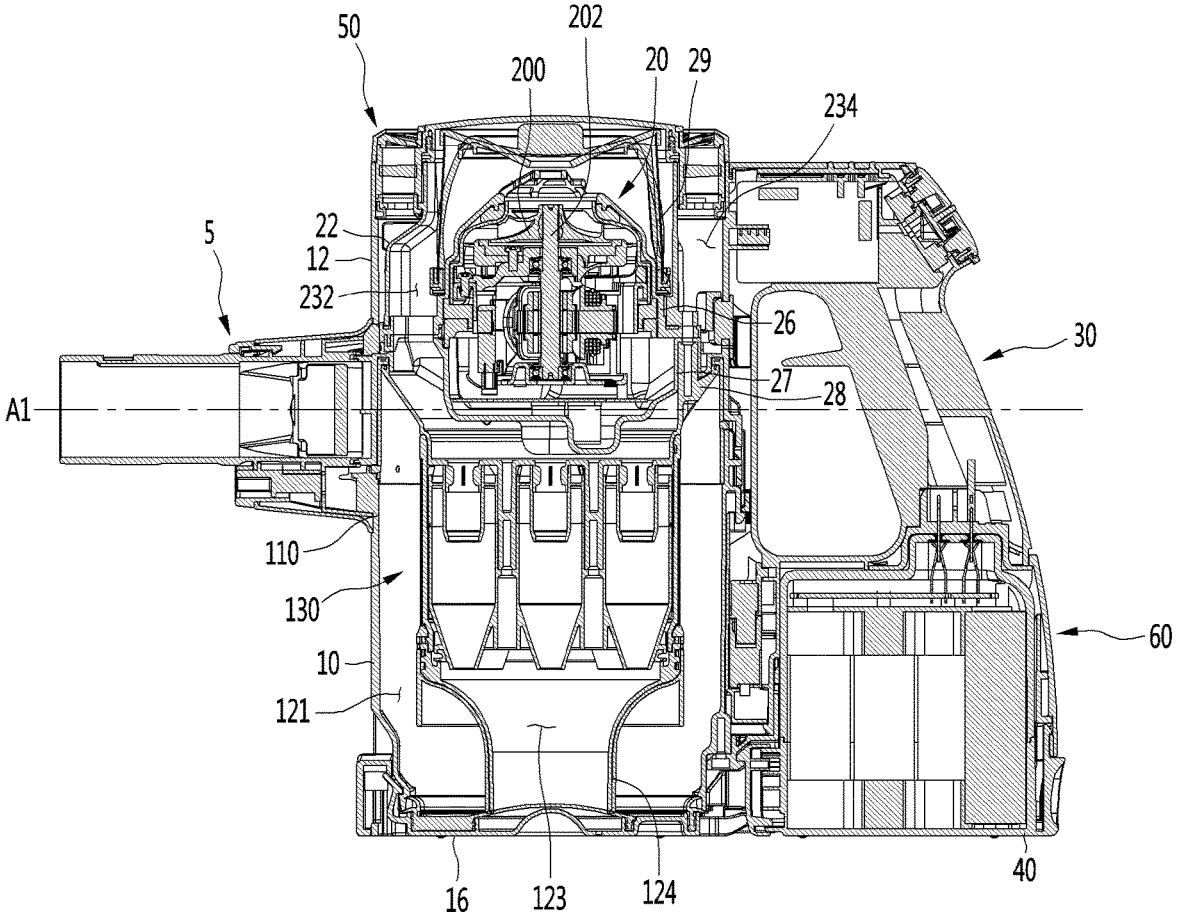
FIG. 5 is a vertical cross-sectional view of the cleaner according to an embodiment of the present invention.

FIG. 1 is a perspective view of a cleaner according to an embodiment of the present invention, FIG. 2 is a side view of the cleaner according to an embodiment of the present invention, FIG. 3 is a plan view of the cleaner according to an embodiment of the present invention, FIG. 4 is a perspective view of the cleaner according to an embodiment of the present invention when seen from under the cleaner, and FIG. 5 is a cross-sectional view of the cleaner according to an embodiment of the present invention.

Referring to FIGS. 1 to 5, a cleaner 1 according to an embodiment of the present invention may include a main body 2.

The cleaner 1 may further include a suction unit 5 coupled to the front of the main body 2. The suction unit 5 can guide air containing dust into the main body 2.

The cleaner 1 may further include a handle unit 3 coupled to the main body 2. The handle unit 3 may be positioned opposite to the suction unit 5 on the main body 2.

That is, the main body 2 may be disposed between the suction unit 5 and the handle unit 3.

The main body 2 may include a first body 10 and a second body 12 on the first body 10. The first body 10 and the second body 12 may be directly combined or may be indirectly combined through an intermediate member.

The first body 10 and the second body 12 may be, though not limited thereto, formed in a cylindrical shape.

The first body 10 and the second body 12 are open at the top and the bottom, respectively. That is, the bodies 10 and 12 may have a top opening and a bottom opening, respectively.

The suction unit 5 may be coupled to the main body 2 such that the center of the suction unit 5 is positioned approximately at the boundary between the first body 10 and the second body 12.

The main body 2 may further include a dust separation unit that separates dust from air sucked through the suction unit 5.

The dust separation unit may include a first cyclone unit 110 that can separate dust, for example, using cyclonic flow. The first body 10 includes the first cyclone unit 110 in this configuration.

The air and dust sucked through the suction unit 5 helically flow along the inner side of the first cyclone unit 110.

The axis of the cyclonic flow in the first cyclone unit 110 may vertically extend.

The dust separation unit may further include a second cyclone unit 130 that secondarily separates dust from the air discharged out of the first cyclone unit 110. The second cyclone unit 130 may be disposed inside the first cyclone unit 110 to minimize the size of the dust separation unit. The second cyclone unit 130 may include a plurality of cyclone bodies arranged in a raw.

As another example, the dust separation unit may include one cyclone unit, in which the axis of the cyclonic flow may also vertically extend.

The first body 10 functions as a dust container that stores dust separated by the cyclone units 180 and 190.

The main body 2 may further include a body cover 16 for opening/closing the bottom of the first body 10. The body cover 16 can open/close the first body 10 by being rotated. A button 18 for rotating the body cover 16 may be disposed on the first body 10. A hinge 162 of the body cover 16 may be coupled to hinge coupling portions 620 of the battery housing 60.

At least a portion of the second cyclone unit 130 may be positioned inside the first body 10.

A dust storage guide 184 that guides the dust separated by the second cyclone unit 130 to be stored may be disposed in the first body 10. The dust storage guide 184 may be coupled to the bottom of the second cyclone unit 130 in contact with the top of the body cover 16.

The dust storage guide 184 may divide the internal space of the first body 10 into a first dust storage part 181 where the dust separated by the first cyclone unit 110 is stored and a second dust storage part 183 where the dust separated by the second cyclone unit 130 is stored.

The internal space of the dust storage guide 184 is the second dust storage part 183 and the space between the dust storage guide 184 and the first body 10 is the first dust storage part 181.

The body cover 16 can open/close both of the first dust storage part 181 and the second dust storage part 183.

The cleaner 1 may further include a suction motor 20 for generating suction force and a battery 40 for supplying power to the suction motor 20.

The suction motor 20 may be disposed in the second body 12. At least a portion of the suction motor 20 may be disposed over the dust separation unit. Accordingly, the suction motor 20 is disposed over the first body 10.

The suction motor 20 may communicate with an outlet of the second cyclone unit 130.

To this end, the main body 2 may further include a discharge guide 28 connected to the second cyclone unit 130 and a flow guide 22 that communicates with the discharge guide 28.

For example, the discharge guide 28 is disposed on the second cyclone unit 130 and the flow guide 22 is disposed over the discharge guide 28.

Further, at least a portion of the suction motor 20 is positioned inside the flow guide 22.

Accordingly, the axis of the cyclonic flow in the first cyclone unit 110 may pass through the suction motor 20.

When the suction motor 20 is disposed over the second cyclone unit 130, the air discharged from the second cyclone unit 130 can flow directly to the suction motor 20, so the channel between the dust separation unit and the suction motor 20 can be minimized.

The suction motor 20 may include a rotary impeller 200. The impeller 200 may be fitted on a shaft 202. The shaft 202 is vertically disposed.

An extension line from the shaft 202 (which may be considered as the rotational axis of the impeller 200) may pass through the first body 10. The rotational axis of the impeller 200 and the axis of the cyclonic flow in the first cyclone unit 110 may be on the same line.

According to the present embodiment, there is the advantage that the path through which the air discharged from the dust separation unit, that is, the air discharged upward from the second cyclone unit 130 flows to the suction motor 20 can be reduced and a change in direction of air can be decreased, so a loss of airflow can be reduced.

As the loss of airflow is reduced, suction force can be increased and the lifetime of the battery 40 for supplying power to the suction motor 20 can be increased.

The cleaner 1 may further include an upper motor housing 26 covering a portion of the top of the suction motor 20 and a lower motor housing 27 covering a portion of the bottom of the suction motor 20. The lower motor housing 27 may be integrally formed with the second body 12 or may be coupled to the second body 12.

The suction motor 20 may be disposed inside the motor housings 26 and 27 and the flow guide 22 may be disposed to cover the upper motor housing 26.

At least a portion of the flow guide 22 may be spaced apart from the upper motor housing 26. Further, at least a portion of the flow guide 22 may be spaced apart from the second body 12.

Accordingly, a first air passage 232 is defined by the inner side of the flow guide 22 and the outer side of the upper motor housing 26 and a second air passage 234 is defined by the outer side of the flow guide 22 and the inner side of the second body 12.

The air discharged from the second cyclone unit 130 flows to the suction motor 20 through the first air passage 232 and the air discharged from the suction motor 20 flows through the second air passage 234 and is then discharged outside. Accordingly, the second air passage 234 functions as an exhaust channel.

The handle unit 3 may include a handle 30 for a user to hold and a battery housing 60 under the handle 30.

The handle 30 may be disposed behind the suction motor 20.

As for directions, with respect to the suction motor 20 in the cleaner 1, the direction in which the suction unit 5 is positioned is the front direction and the direction in which the handle 30 is positioned is the rear direction.

The battery 40 may be disposed behind the first body 10. Accordingly, the suction motor 20 and the battery 40 may be arranged not to vertically overlap each other and may be disposed at different heights.

According to the present embodiment, since the suction motor 20 that is heavy is disposed ahead of the handle 30 and the battery 40 that is heavy is disposed behind the handle 30, so weight can be uniformly distributed throughout the cleaner 1. It is possible to prevent injuries to the user's wrist when a user cleans with the handle 30 in his/her hand. That is, since the heavy components are distributed at the front and rear portions and at different heights in the cleaner 1, it is possible to prevent the center of gravity of the cleaner 1 from concentrating on any one side.

Since the battery 40 is disposed under the handle 30 and the suction motor 20 is disposed in front of the handle 30, there is no component over the handle 30. That is, the top of the handle 30 forms a portion of the external appearance of the top of the cleaner 1.

Accordingly, it is possible to prevent any component of the cleaner 1 from coming in contact with the user's arm while the user cleans with the handle 30 in his/her hand.

The handle 30 may include a first extension 310 extending vertically to be held by a user and a second extension 320 extending toward the suction motor 20 over the first extension 310. The second extension 320 may at least partially horizontally extend.

In the present embodiment, the first extension 310, which is a portion that a user can hold (a portion that a user's palm can come in contact with), may be referred to as a grip.

A stopper 312 for preventing a user's hand holding the first extension 310 from moving in the longitudinal direction of the first extension 310 (vertically in FIG. 2) may be formed on the first extension 310. The stopper 312 may extend toward the suction unit 5 from the first extension 310.

The stopper 312 is spaced apart from the second extension 320. Accordingly, a user is supposed to hold the first extension 310, with some of the fingers over the stopper 312 and the other fingers under the stopper 312.

For example, the stopper 312 may be positioned between the index finger and the middle finger.

According to this arrangement, when a user holds the first extension 310, the longitudinal axis A1 of the suction unit 5 may pass through the user's wrist.

When the longitudinal axis A1 of the suction unit 5 passes through the user's wrist and the user's arm is stretched, the longitudinal axis A1 of the suction unit 5 may be substantially aligned with the user's stretched arm. Accordingly, there is the advantage in this state that the user uses minimum force when pushing or pulling the cleaner 1 with the handle 30 in his/her hand.

The handle 30 may include an operation unit 350. For example, the operation unit 350 may be disposed on an inclined surface of the second extension 320. It is possible to input instructions to turn on/off the cleaner (suction motor) through the operation unit 350. Further, it is possible to control the intensity of the suction force of the suction motor 20 that has been turned on through the operation unit 350.

The operation unit 350 may be disposed to face a user. The operation unit 350 may be disposed opposite to the stopper 312 with the handle 30 there between.

The operation unit 350 is positioned higher than the stopper 312. Accordingly, a user can easily operate the operation unit 350 with his/her thumb with the first extension 310 in his/her hand.

Further, since the operation unit 350 is positioned outside the first extension 310, it is possible to prevent the operation unit 350 from being unexpectedly operated when a user cleans with the first extension 310 in his/her hand.

A display unit 322 for showing operational states may be disposed on the second extension 320. The display unit 322 may be, for example, disposed on the top of the second extension 320. Accordingly, a user can easily check the display unit 322 on the top of the second extension 320 while cleaning. The display 322, for example, can show the remaining capacity of the battery 40 and the intensity of the suction motor.

The display unit 322, though not limited, may include a plurality of light emitting devices. The light emitting devices may be spaced from each other in the longitudinal direction of the second extension 320.

The battery housing 60 may be disposed under the first extension 310.

The battery 40 may be detachably combined with the battery housing 60. For example, the battery 40 may be inserted into the battery housing 60 from under the battery housing 60.

The rear side of the battery housing 60 and the rear side of the first extension 310 may form a continuous surface. Accordingly, the battery housing 60 and the first extension 310 can be shown like a single unit.

When the battery 40 is inserted in the battery housing 60, the bottom of the battery 40 may be exposed to the outside. Accordingly, when the cleaner 1 is placed on the floor, the battery 40 can be in contact with the floor.

According to this structure, there is the advantage that the battery 40 can be directly separated from the battery housing 60.

Further, since the bottom of the battery 40 is exposed to the outside, the bottom of the battery 40 can come in direct contact with the air outside the cleaner 1, so the battery 40 can be more efficiently cooled.

Referring to FIG. 3, the cleaner 1 may further include a filter unit 50 having air exits 522 for discharging the air that has passed through the suction motor 20. For example, the air exits 522 may include a plurality of openings and the openings may be circumferentially arranged. Accordingly, the air exits 522 may be arranged in a ring shape.

The filter unit 50 may be detachably coupled to the top of the main body 2. The filter unit 50 may be detachably inserted in the second body 12.

When the filter unit 50 is combined with the main body 2, a portion of the filter unit 50 is positioned outside the second body 12. Accordingly, a portion of the filter unit 50 is inserted in the main body 2 through the open top of the main body 2 and the other portion protrudes outside from the main body 2.

The height of the main body 2 may be substantially the same as the height of the handle 30. Accordingly, the filter unit 50 protrudes upward from the main body 2, so a user can easily hold and separate the filter unit 50.

When the filter unit 50 is combined with the main body 2, the air exits 522 are positioned at the upper portion of the filter unit 50. Accordingly, the air discharged from the suction motor 20 is discharged upward from the main body 2.

According to this embodiment, it is possible to prevent the air discharged from the air exits 522 from flowing to a user while the user cleans using the cleaner 1.

The main body 2 may further include a pre-filter 29 for filtering the air flowing into the suction motor 20. The pre-filter 29 may be disposed inside the flow guide 22. Further, the pre-filter 29 is seated over the upper motor housing 16 and may surround a portion of the upper motor housing 26. That is, the upper motor housing 26 may include a filter support for supporting the pre-filter 29.

Figure 6:
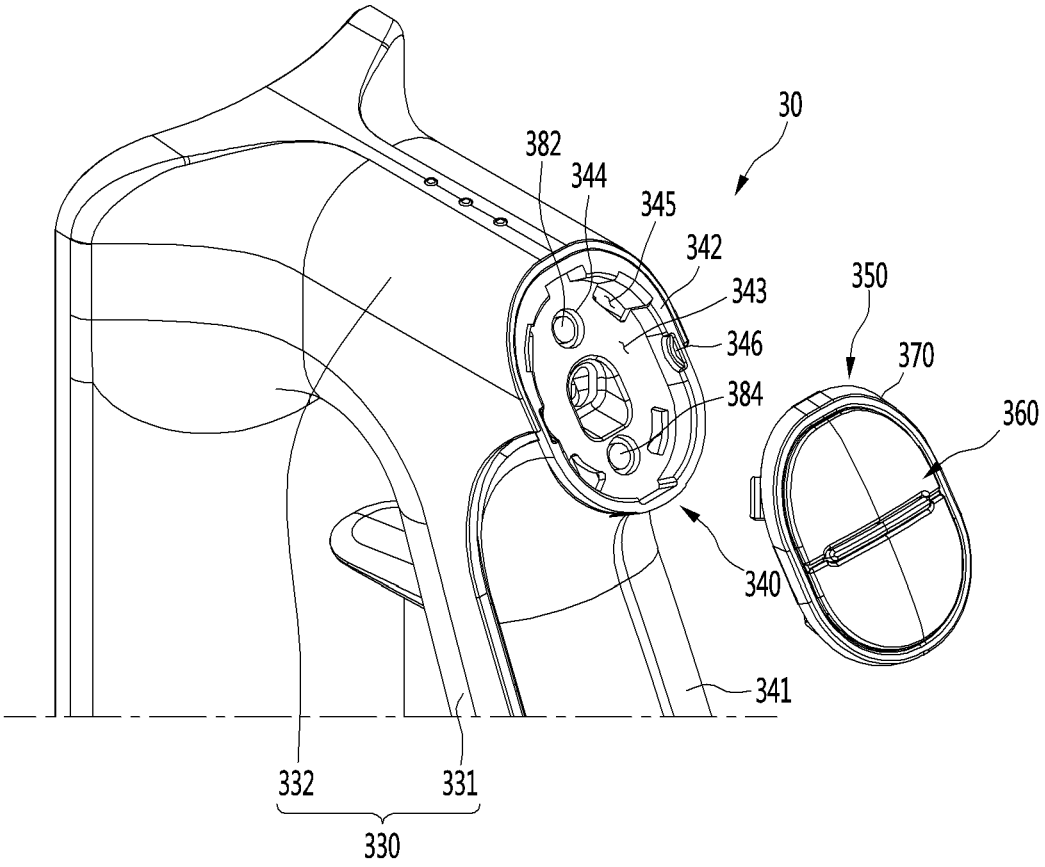
FIG. 6 is a view showing a handle unit according to an embodiment of the present invention with an operation unit separated.
Figure 7:
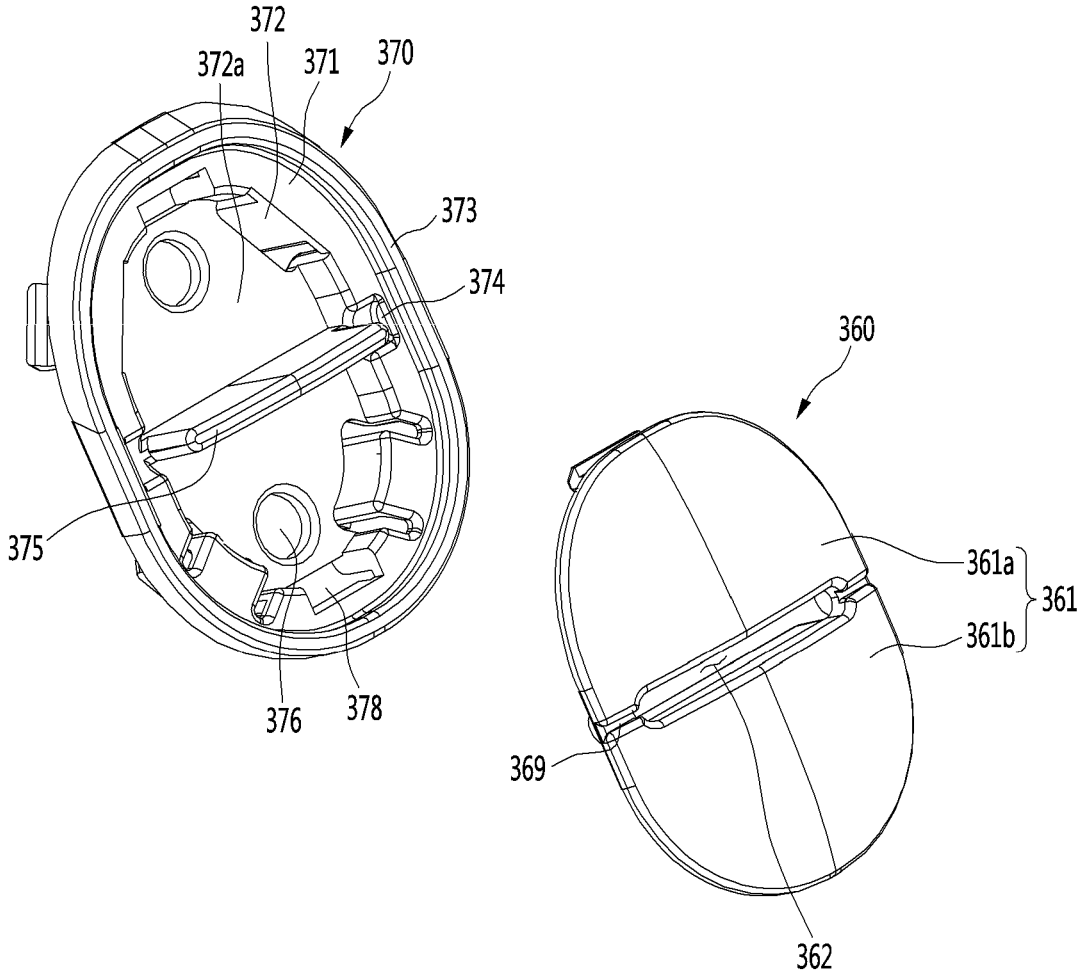
FIG. 7 is an exploded perspective view of the operation unit according to an embodiment of the present invention.
Figure 8:
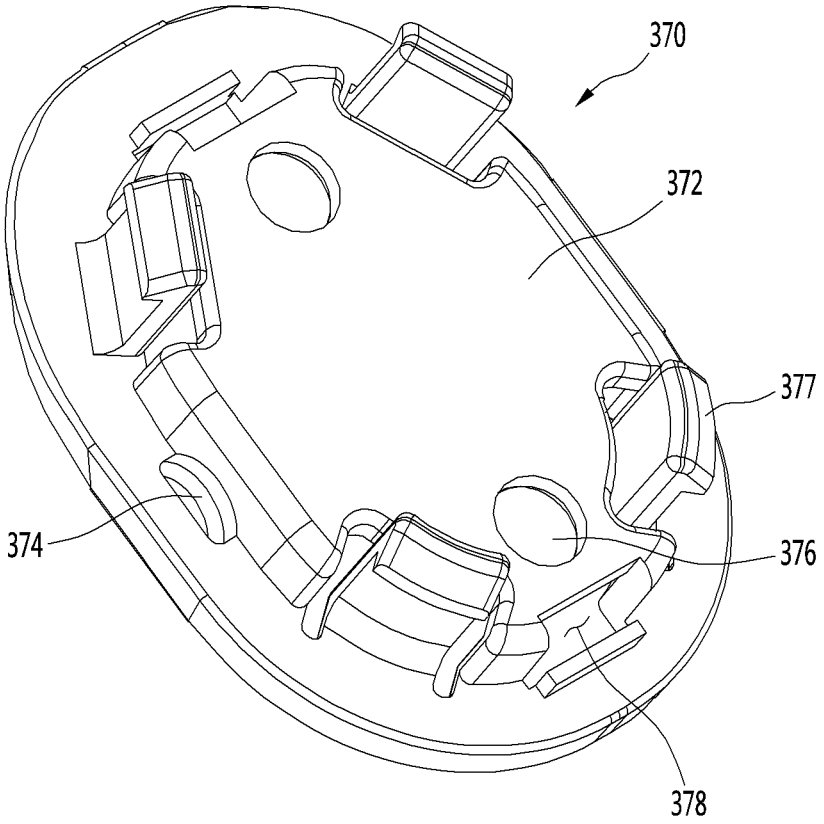
FIG. 8 is a perspective view of a support frame according to an embodiment of the present invention.
Figure 9:
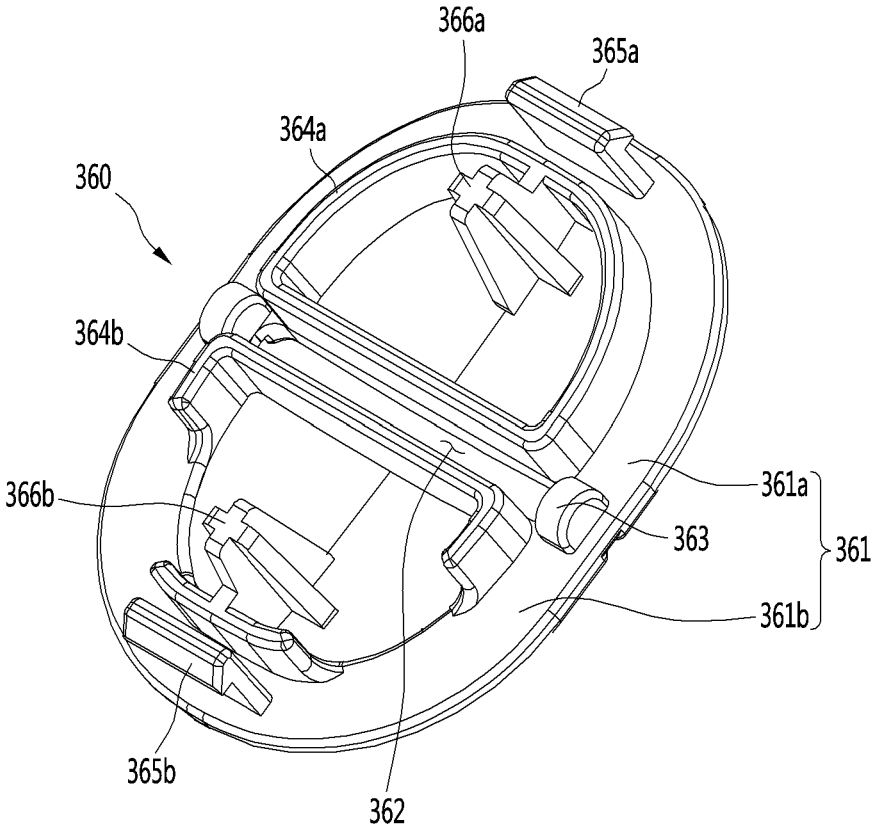
FIG. 9 is a perspective view of an operation button according to an embodiment of the present invention.

FIG. 6 is a view showing a handle unit according to an embodiment of the present invention with an operation unit separated, FIG. 7 is an exploded perspective view of the operation unit according to an embodiment of the present invention, FIG. 8 is a perspective view of a support frame according to an embodiment of the present invention, and FIG. 9 is a perspective view of an operation button according to an embodiment of the present invention.

Referring to FIGS. 6 to 9, the external shape of the handle 30 according to this embodiment may be formed by a handle body 330 and a handle cover 340 coupled to the handle body 330.

When the handle cover 340 is coupled to the handle body 330, the handle cover 340 and the handle body 330 form the first extension 310 and the second extension 320.

The handle body 330 may include a first handle body 331 and a second handle body 332 disposed over the first handle body 331.

The handle cover 340 may include a first cover 341 and a second cover 342 disposed over the first cover 341.

When the first cover 341 is coupled to the first handle body 331, the first handle body 331 and the first cover 341 form the first extension 310. Further, when the second cover 342 is coupled to the second handle body 332, the second handle body 332 and the second cover 342 form the second extension 320.

Though not limited, the operation unit 350 may be coupled to the second cover 342.

When the handle body 330 and the handle cover 340 are separately formed, a structure for installing a circuit board in the handle body 330 and coupling the operation unit 350 to the handle cover 340 may be formed.

The second cover 342 may have a seat 343 that can keep a portion of the operation unit 350. The seat 343 may be formed by recessing a portion of the second cover 342.

The handle 30 may further include a first switch 382 and a second switch 384 for receiving operation instructions from the operation unit 350. The first switch 382 and the second switch 384 may be positioned at different heights.

Though not limited, it is possible to receive instructions to turn on and off the suction motor 20 (or they may be referred to as a "first instruction" and a "third instruction", respectively) through the first switch 382 and instructions to control the intensity of the suction force of the suction motor 20 (it may be referred to as a "second instruction") through the second switch 384.

A pair of holes 344 for receiving a portion of the operation unit 350 may be formed at the second cover 342. The holes 344 may be arranged to face the first switch 382 and the second switch 384, respectively.

The holes 344 may be formed, for example, through the seat 343.

The operation unit 350 may include an operation button 360 and a support frame 370 supporting the operation button 360.

The operation button 360 may be movably coupled to the support frame 370 and the support frame 370 may be coupled to the second cover 342.

The operation button 360 may include a button body 361. A separation slit 362 for dividing the button body 361 into two parts may be formed substantially at the center of the button body 361.

The button body 361 may have a first push part 361*a* and a second push part 361*b* separated by the separation slit 362.

The button body 361 may further has cut grooves at both sides from the separation slit 362. The cut grooves 369 make the push parts 361*a* and 361*b* be visually distinguished.

The button body 361 may be formed in an elliptical shape so that a user can operate the two push parts 361*a* and 361*b* and the contact area with a finger is improved.

When the operation unit 350 is coupled to the handle 30, the first push part 361*a* and the second push part 361*b* may be arranged up and down. That is, the first push part 361*a* and the second push part 361*b* may be positioned at different heights.

The first push part 361*a* may have a first push projection 366*a* for pressing the first switch 382 and the second push part 361*b* may have a second push projection 366*b* for pressing the second switch 384.

The first push part 361*a* and the second push part 361*b* may have reinforcing ribs 364*a* and 364*b* for improving strength, respectively.

The reinforcing ribs 364*a* and 364*b* may be bent at several portions to increase the reinforcing effect by the reinforcing ribs 364*a* and 364*b*.

Further, the push projections 366*a* and 366*b* may be integrally formed with the reinforcing ribs 364*a* and 364*b* to prevent breakage of the push projections 366*a* and 366*b*.

The operation button 360 may further have one or more button hooks 365*a* and 365*b* to be coupled to the support frame 370.

The operation button 360 may have a plurality of button hooks 365*a* and 365*b* to stably retain the operation button 360 inside the support frame 370.

The button hooks 365*a* and 365*b* may be arranged up and down on the operation button 360 so that the coupling force to the support frame 370 at the first push part 361*a* and the coupling force to the support frame 370 at the second push part 361*b* are substantially the same.

That is, the first button hook 365*a* may be formed on the first push part 361*a* and the second button hook 365*b* may be formed on the second push part 361*b*.

The first push projection 366*a* and the second push projection 366*b* may be disposed between the first button hook 365*a* and the second button hook 365*b*.

For example, the first button hook 365*a*, the first push projection 366*a*, the second push projection 366*b*, and the second button hook 365*b* may be arranged in a line.

The operation button 360 may further have hinges 363 for preventing the first push part 361*a* and the second push part 361*b* from simultaneously pressing the first switch 382 and the second switch 384 when a user operates the operation button 360.

For example, the hinges 363 provide pivots protruding on the button body 361 so that the entire operation button 360 is rotated when any one of the first push part 361*a* and the second push part 361*b* is pressed.

The hinges 363 may be disposed at both sides from the separation slit 362 so that the entire button body 361 is stably rotated by the hinges 363.

That is, a pair of hinges 363 may protrude from the button body 361 and the separation slit 362 may be disposed between the hinges 363.

The support frame 370 may have a frame body 371 on which the operation button 360 is seated.

The frame body 371 may have a recession 372 to receive at least the reinforcing ribs 364*a* and 364*b* of the operation button 360.

The frame body 371 may further have a separator 375 inserted through the separation slit 362 of the operation button 360. The separator 375 may protrudes from the bottom 372*a* of the recession 372.

The frame body 371 may have one or more hook holes 378 for locking the button hooks 365*a* and 365*b* of the operation button 360.

When the operation button 360 has a plurality of button hooks 365*a* and 365*b*, the frame body 371 may also have a plurality of hook holes 378.

The frame body 371 may further have projection holes 376 through which the push projections 366*a* and 366*b* of the operation button 360 are inserted.

The projection holes 376, for example, may be formed through the bottom 372*a* of the recession 372.

The frame body 371 may have one or more frame hooks 377 to be coupled to the handle cover 340. FIG. 8 shows an example in which the frame body 371 has a plurality of frame hooks 377.

A plurality of coupling holes 345 for coupling the frame hooks 377 may be formed at the second cover 342.

The frame body 371 may further have hinge seats 374 in which the hinges 363 of the operation button 360 are seated. For example, a pair of hinge seats 374 may be formed on the frame body 371. Further, the separator 375 may be positioned between the pair of hinge seats 374.

The hinge seats 374 may be recessed on the frame body 371 and may have a rounded surface so that the hinges 363 can be rotated.

The heights of the hinge 373 from the button body 360 may be larger than the depths of the hinge sets 374 so that the operation button 360 can be rotated without interference with the frame body 371, with the hinges 363 in the hinge seats 374.

That is, the hinges 363 of the operation button 360 may be partially seated in the hinge seats 374.

When the hinge seats 374 are formed on the frame body 371, the portions, which correspond to the hinge seats 374, of the frame body 371 protrude outward. Grooves 346 for receiving the portions protruding outward from the frame body 371 may be formed at the second cover 342.

The hook holes 378 may be larger in size than the button hooks 365*a* and 365*b* so that the operation button 360 can be rotated on the hinges 363 with the button hooks 365*a* and 365*b* of the operation button 360 fitted in the hook holes 378 of the support frame 370.

However, the maximum gap between the button hooks 365*a* and 365*b* may be made substantially the same as the maximum gap between the hook holes 378 to keep the button hooks 365*a* and 365*b* in the hook holes 378.

The minimum gap between the hook holes 378 may be made smaller than the minimum gap between the button hooks 365*a* and 365*b*. Accordingly, when the button hooks 365*a* and 365*b* are fitted in the hook holes 378, respectively, spaces in which the button hooks 365*a* and 365*b* can move when the operation button 360 is rotated can be formed in the hook holes 378.

The support frame 370 may further have an outer rib 373 protruding along the edge of the frame body 371. When the operation button 360 is coupled to the support frame 370, the outer rib 373 surrounds the outer edge of the operation button 360.

Figure 10:
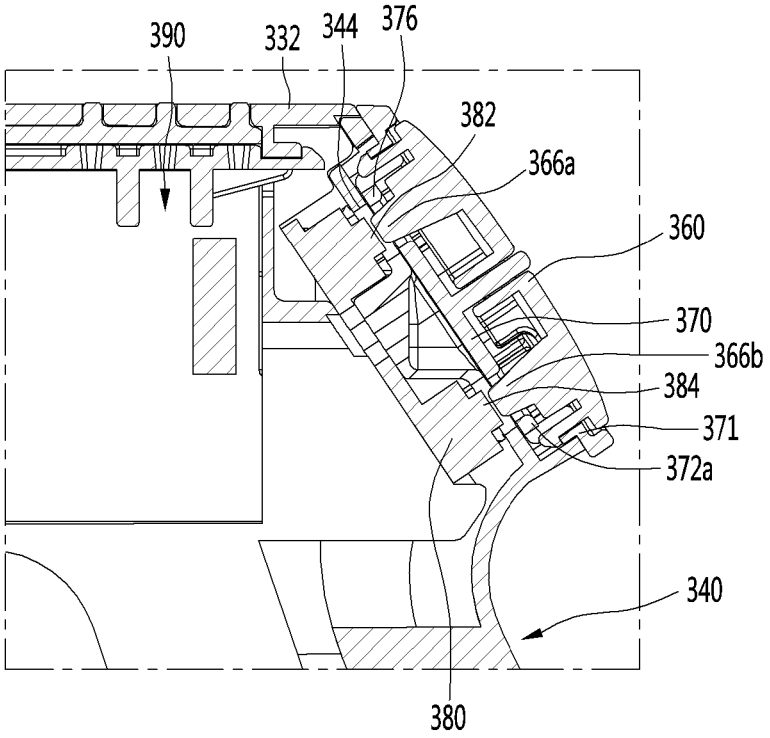
FIG. 10 is a cross-sectional view showing the operation unit of the present invention combined with the handle.
Figure 11:
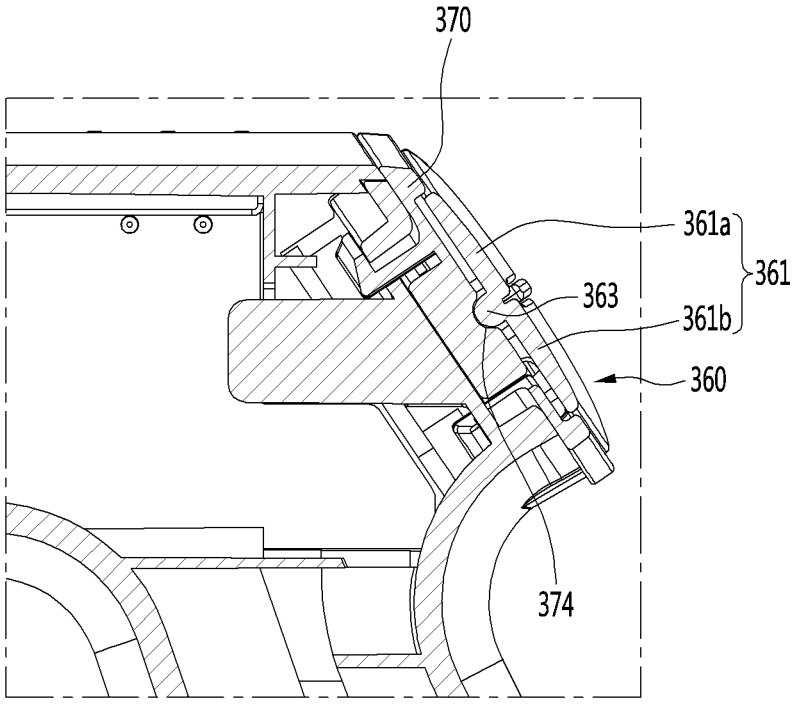
FIG. 11 is a view showing a hinge of the operation unit seated in a hinge seat of the support frame.

FIG. 10 is a cross-sectional view showing the operation unit of the present invention combined with the handle and FIG. 11 is a view showing a hinge of the operation unit seated in a hinge seat of the support frame.

Referring to FIGS. 6 to 10, the first switch 382 and the second switch 384 may be disposed on a power PCB 380. The power PCB 380 may be electrically connected to a main PCB 390 disposed in the handle 30. The main PCB 390 can supply power to the suction motor 20 and generate control signal for the suction motor 20.

The power PCB 380 may be seated in the second handle body 332 and covered with the handle cover 340 when the handle cover 340 is coupled to the handle body 330.

The first switch 382 and the second switch 384 may be respectively aligned with the holes 344 of the handle cover 340. Further, the switches 382 and 384 are arranged to respectively face the projection holes 376 of the support frame 370.

When the operation unit 350 is combined with the handle cover 340, the push projections 366*a* and 366*b* of the operation button 360 may pass through the holes 344 or may be positioned in the holes 344.

However, the push projections 366*a* and 366*b* may be spaced from the switches 382 and 384.

Further, when the operation button 360 is coupled to the support frame 370, the hinges 363 of the operation button 360 are seated in the hinge seats 374 of the support frame 370.

As described above, since the heights of the hinges 363 from the button body 360 are larger than the depths of the hinge seats 374, the button body 361 is spaced from the frame body 371 with the hinges 363 seated in the hinge seats 374.

Further, the reinforcing ribs 364*a* and 364*b* of the operation button 360 are spaced from the bottom 372*a* of the recession 372 of the frame body 371 with the hinges 363 seated in the hinge seats 374.

Figure 12:
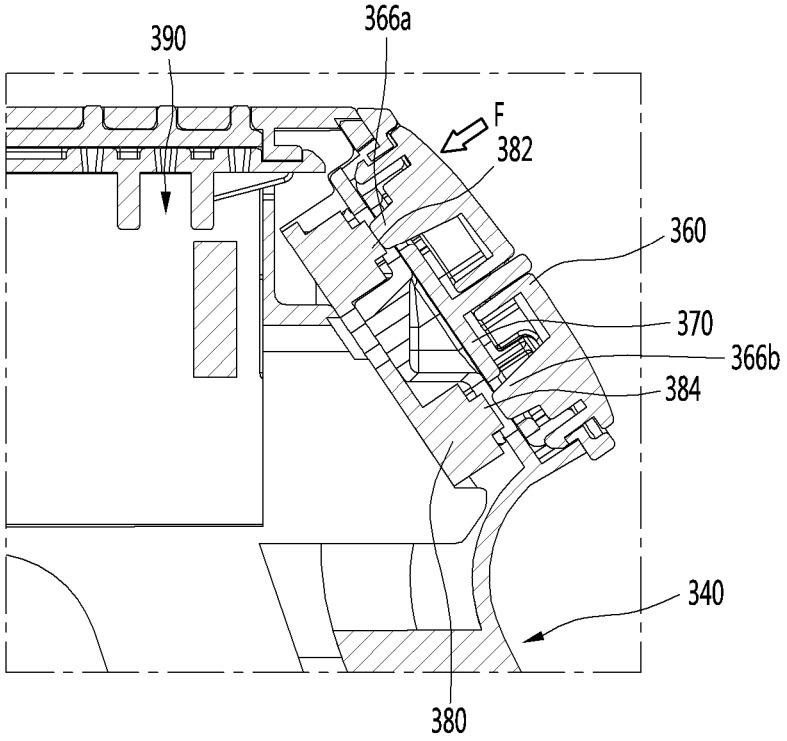
FIG. 12 is a view showing the operation button with a first push part pressed.
Figure 13:
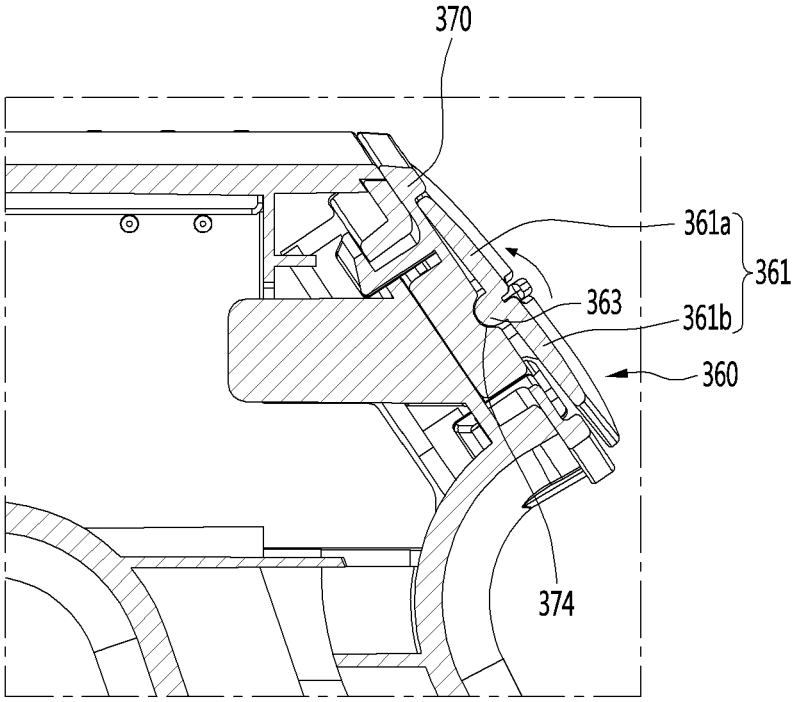
FIG. 13 is a view showing the positional relationship between the operation button and the support frame in the state shown in FIG. 12.

FIG. 12 is a view showing the operation button with the first push part pressed and FIG. 13 is a view showing the positional relationship between the operation button and the support frame in the state shown in FIG. 12.

Referring to FIGS. 2, 12, and 13, a user can push the first push part 361*a* of the operation button 360 with the first extension 310 of the handle 30 in his/her hand in order to turn on or off the suction motor 20.

When the first push part 361*a* is pushed, the operation button 360 is rotated counterclockwise about the hinges 363 in the drawings, so the first push projection 366*a* presses the first switch 382. Accordingly, the suction motor 20 can be turned on or off.

The first push part 361*a* may be pressed, for example, by a thumb. Since the first push part 361*a* and the second push part 361*b* are arranged up and down, when a user holds the first extension 310 with a hand, the user's thumb may be positioned up and down. In this case, when the user presses the first push part 361*a* in this state, a portion of his/her thumb may come in contact with the second push part 361*b*.

However, since the hinges 363 are disposed between the first push part 361*a* and the second push part 361*b* in this embodiment, even if a force is independently applied to the first push part 361*a* and the second push part 361*b*, when the force applied to the first push part 361*a* is larger than the force applied to the second push part 361*b*, the push parts 361*a* and 361*b* cannot be simultaneously rotated and the operation button 360 is rotated counterclockwise in the drawings by the force applied to the first push part 361*a*.

Therefore, according to the present embodiment, it is possible to prevent the push parts 361*a* and 361*b* from simultaneously pressing the switches 382 and 384.

Figure 14:
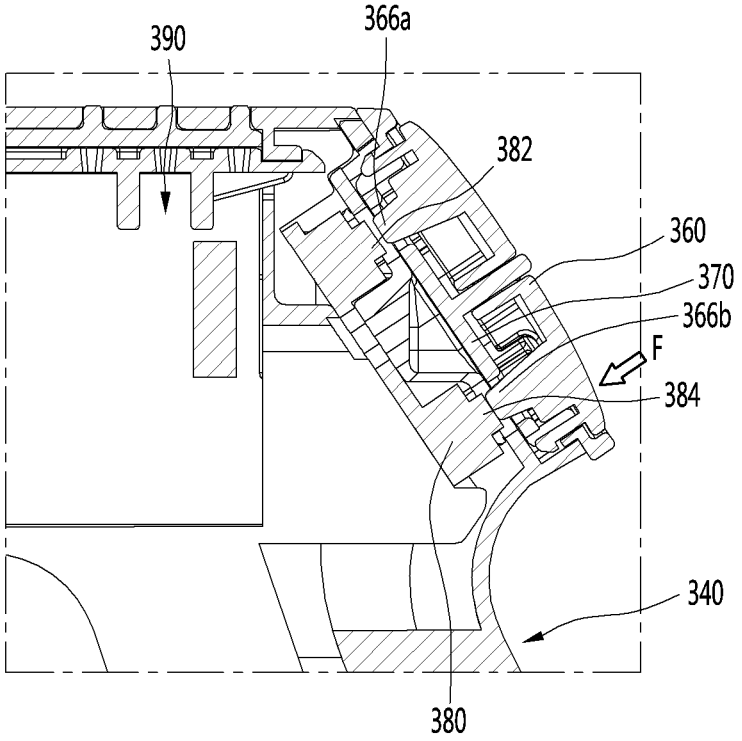
FIG. 14 is a view showing the operation button with a second push part pressed.
Figure 15:
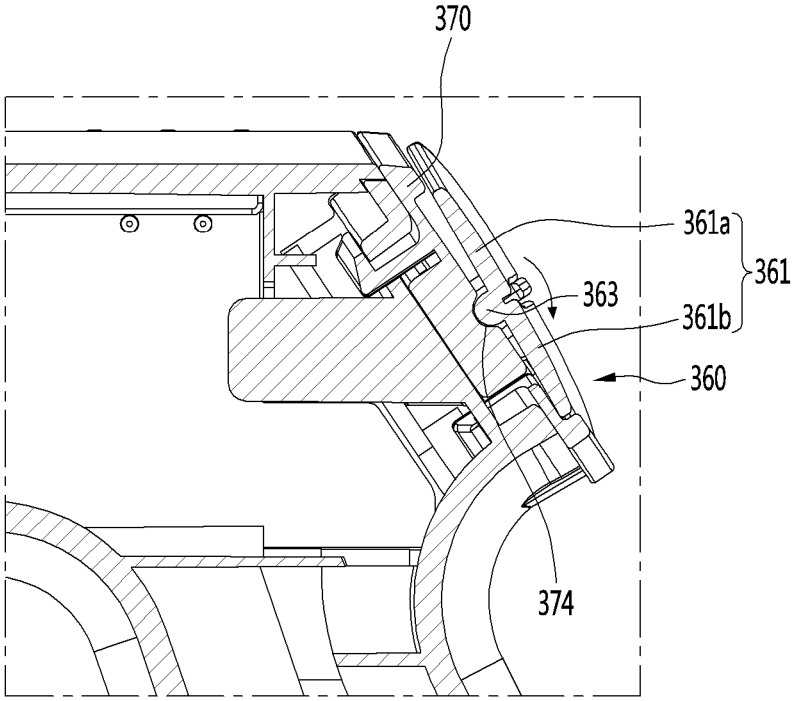
FIG. 15 is a view showing the positional relationship between the operation button and the support frame in the state shown in FIG. 14.

FIG. 14 is a view showing the operation button with the second push part pressed and FIG. 15 is a view showing the positional relationship between the operation button and the support frame in the state shown in FIG. 14.

Referring to FIGS. 2, 14, and 15, a user can push the second push part 361*b* of the operation button 360 with the first extension 310 of the handle 30 in his/her hand in order to adjust the intensity of the suction force the suction motor 20.

When the second push part 361*b* is pushed, the operation button 360 is rotated clockwise about the hinges 363 in the drawings, so the second push projection 366*b* presses the second switch 384. Accordingly, the intensity of the suction force of the suction motor 20 can be increased or decreased.

The second push part 361*b* may be pressed by a thumb, and the first push part 361*a* and the second push part 361*b* are arranged up and down, so it is possible to prevent the first push part 361*a* from being pushed when the second push part 361*b* is pushed.

Therefore, it is possible to prevent the push parts 361*a* and 361*b* from simultaneously pressing the switches 382 and 384.

Further, according to the present embodiment, since the operation button has the first push part and the second push part, it is possible not only to input instructions to turn on and off the suction motor with one finger, but to adjust the intensity of the suction force of the suction motor, so a user can more conveniently use the cleaner.

Further, according to the present embodiment, the operation button is coupled to the support frame with the support frame coupled to the handle cover, and the operation button that has been coupled to the support frame can be rotated.

Accordingly, the support frame is coupled to the handle cover even if there is a gap between the operation button and the support frame, it is possible to prevent foreign substances flowing inside through the gap between the support frame and the operation button from flowing into the handle. That is, the support frame blocks foreign substances flowing inside, in addition to supporting the operation frame.

What is claimed is:

1. A cleaner comprising:

a main body provided with a suction unit for sucking air and dust, an impeller and a suction motor for generating suction force to the suction unit;

a handle disposed on an opposite side of the suction unit relative to the suction motor for a user to grasp; and a battery housing disposed under the handle and to which a battery is detachably coupled, wherein the handle includes:

a first extension extending upward from the battery housing to have an inclination to a longitudinal axis (A1) of the suction unit;

a second extension extending forward from a top of the first extension toward the suction motor and having an inclined surface having an inclination to the longitudinal axis (A1) of the suction unit on a rear surface of the second extension; and an operation unit disposed on the inclined surface to input a control instruction, wherein:

with respect to the longitudinal axis (A1), an inclination of the inclined surface is different from an inclination of the first extension, and in front of the second extension, an air exits are disposed which is arranged in a circumferential direction with respect to a rotation axis (B1) of the impeller to discharge the air passing through the impeller.

2. The cleaner of claim 1, wherein the suction motor is positioned between the suction unit and the handle, and the inclined surface is arranged to have an inclination with respect to a rotational axis (B1) of the impeller.

3. The cleaner of claim 2, wherein an imaginary straight line extending along the inclined surface intersects the rotational axis of the impeller or the longitudinal axis (A1) of the suction unit.

4. The cleaner of claim 1, wherein the suction unit, the air exits and the operation unit are sequentially arranged in the front-rear direction.

5. The cleaner of claim 4, wherein a diameter of the air exits is larger than a width of the operation unit.

6. The cleaner of claim 1, wherein the inclination of the inclined surface with respect to the longitudinal axis (A1) is less than the inclination of the first extension with respect to the longitudinal axis (A1).

7. The cleaner of claim 1, wherein the handle further includes a stopper extending from the first extension toward the suction unit.

8. The cleaner of claim 7, wherein the operation unit is disposed on an opposite side of the stopper.

9. The cleaner of claim 7, wherein the operation unit is disposed higher than the stopper.

10. The cleaner of claim 7, wherein the stopper is extended so that an end portion of the stopper is spaced apart from the main body.

11. The cleaner of claim 7, wherein the stopper is positioned closer to the second extension than the longitudinal axis (A1) of the suction unit.

12. The cleaner of claim 7, wherein the stopper is spaced apart from the second extension.

13. The cleaner of claim 1, wherein the handle further includes a display unit installed on the second extension and displaying operational states.

14. The cleaner of claim 13, wherein the display unit is provided with a plurality of light emitting devices to provide intensity information of the suction motor.

* * * * *